US009162342B2

(12) United States Patent
Kim et al.

(10) Patent No.: US 9,162,342 B2
(45) Date of Patent: Oct. 20, 2015

(54) CARRIER HEAD AND CARRIER HEAD UNIT

(75) Inventors: Oh Su Kim, Suwon-Si (KR); John Ho Kuk, Suwon-Si (KR)

(73) Assignee: Oh Su Kim (KR)

( * ) Notice: Subject to any disclaimer, the term of this patent is extended or adjusted under 35 U.S.C. 154(b) by 767 days.

(21) Appl. No.: 13/353,754

(22) Filed: Jan. 19, 2012

(65) Prior Publication Data

US 2012/0184189 A1 Jul. 19, 2012

(30) Foreign Application Priority Data

Jan. 19, 2011 (KR) ..... 10-2011-0005496

(51) Int. Cl.
*B24B 37/30* (2012.01)
*B24B 37/32* (2012.01)

(52) U.S. Cl.
CPC ..... *B24B 37/30* (2013.01); *B24B 37/32* (2013.01)

(58) Field of Classification Search
CPC ..... B24B 7/24; B24B 37/0053; B24B 37/32; B24B 37/30
USPC ..... 451/285, 289, 290, 288, 390; 269/20, 269/21, 903
See application file for complete search history.

(56) References Cited

U.S. PATENT DOCUMENTS 6,012,964 A * 1/2000 Arai et al. ..... 451/5
6,241,593 B1 * 6/2001 Chen et al. ..... 451/288
6,241,825 B1 * 6/2001 Wytman ..... 118/733
6,272,902 B1 * 8/2001 Chen et al. ..... 73/37
6,698,735 B2 * 3/2004 Zywno ..... 269/21
2002/0094766 A1 * 7/2002 Zuniga et al. ..... 451/287
2002/0098785 A1 * 7/2002 Doan et al. ..... 451/285
2007/0222131 A1 * 9/2007 Fukumoto et al. ..... 269/21
2008/0261497 A1 * 10/2008 Ichinoshime ..... 451/285
2008/0318499 A1 * 12/2008 Yasuda et al. ..... 451/288
2009/0191797 A1 * 7/2009 Nabeya et al. ..... 451/54

FOREIGN PATENT DOCUMENTS

JP 2003-179014 6/2003
KR 1020010008630 A 2/2001
KR 1020010046755 A 6/2001

* cited by examiner

*Primary Examiner* — Monica Carter
*Assistant Examiner* — Marcel Dion

(57) ABSTRACT

Provided are a carrier head and a carrier head unit for sucking and securely supporting a substrate during a chemical mechanical polishing process. The carrier head using sucking force to fix a substrate includes a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes vertically passing through the housing part to communicate with the main passage, a retaining ring coupled to a bottom surface of the housing part of the head main body to close lower portions of the connecting holes, and a cover coupled to a top surface of the head main body to close upper portions of the connecting holes.

7 Claims, 6 Drawing Sheets

CARRIER HEAD AND CARRIER HEAD UNIT

CROSS-REFERENCE TO RELATED APPLICATION

This application claims priority to Korean Patent Application No. 10-2011-0005496 filed on Jan. 19, 2011 and all the benefits accruing therefrom under 35 U.S.C. §119, the contents of which are incorporated by reference in their entirety.

BACKGROUND

The present disclosure relates to a carrier head and a carrier head unit, and more particularly, to a carrier head and a carrier head unit for sucking and securely supporting a substrate during a chemical mechanical polishing process.

As semiconductor integrated circuits are miniaturized and have a multi-layer structure, a surface of wafers is planarized in a certain semiconductor fabrication process, or a conductive layer is selectively removed from a surface of wafers. To this end, a chemical mechanical polishing (CMP) process is widely used. Recently, as a metal interconnection process is performed using a combination of a chemical mechanical polishing method and a dual damascene method, the chemical mechanical polishing process is becoming increasingly important.

When a semiconductor device is fabricated, a chemical mechanical polishing (CMP) system may perform a global planarization process on a wafer to decrease surface roughness caused by repeated masking, etching, and interconnection processes, thereby removing height differences between a cell region and a peripheral circuit region. In addition, a chemical mechanical polishing system may precisely polish a surface of a wafer to decrease surface roughness caused by a high integrated device fabrication process and a contact/interconnection layer isolation process for forming a circuit.

In a typical chemical mechanical polishing process, slurry is applied to a polishing pad, and a wafer is pressed. In this state, the polishing pad and the wafer are relatively rotated to planarize a surface of the wafer or selectively remove a conductive layer. That is, the polishing pad is used as a mechanical component, and the slurry is used as a chemical component, thereby mechanically and chemically polishing a surface of a wafer.

During a chemical mechanical polishing process, a carrier head applies polishing pressure to a wafer, and rotates the wafer. Further, a carrier head may transfer a wafer. A main body of such a carrier head is provided with a retaining ring that surrounds the side surface of a wafer to prevent a dislocation of the wafer due to a rotational motion.

The retainer ring is coupled to the main body of the carrier head by coupling members such as bolts. The coupling members may be loosen by a vibration due to rotations of the carrier head and the polishing pad during the chemical mechanical polishing process. Accordingly, the retainer ring may be spaced apart or removed from the main body. In this case, the wafer may be improperly supported, or be removed from the carrier head, and thus, the chemical mechanical polishing process should be stopped. Furthermore, the wafer and the carrier head may be damaged.

SUMMARY

The present disclosure provides a carrier head and a carrier head unit, which sense whether a retaining ring surrounding and protecting the side portion of a wafer is spaced away or removed from a head main body by a vibration during a chemical mechanical polishing process.

The present disclosure also provides a carrier head and a carrier head unit, which sense a small gap between a retaining ring and a head main body, thereby stably supporting and polishing a substrate.

In accordance with an exemplary embodiment, a carrier head using sucking force to fix a substrate includes: a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes vertically passing through the housing part to communicate with the main passage; a retaining ring coupled to a bottom surface of the housing part of the head main body to close lower portions of the connecting holes; and a cover coupled to a top surface of the head main body to close upper portions of the connecting holes.

In accordance with another exemplary embodiment, a carrier head using sucking force to fix a substrate includes: a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes vertically passing through the housing part to communicate with the main passage; a retaining ring coupled to a bottom surface of the housing part of the head main body to close lower portions of the connecting holes; and a coupling member coupled through the connecting hole to bring the retaining ring into tight contact with the head main body, wherein an upper circumferential surface of the coupling member is provided with an inner seal ring that tightly contacts an upper portion of a surface defining the connecting hole to close an upper portion of the connecting hole.

In accordance with another exemplary embodiment, a carrier head using sucking force to fix a substrate includes: a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes opened through a bottom surface of the housing part to communicate with the main passage; a retaining ring coupled to the bottom surface of the housing part of the head main body to close lower portions of the connecting holes.

The head main body may be provided with a plurality of auxiliary passages that communicate with the connecting holes, respectively, and a connecting passage that connects the auxiliary passages to each other.

A lower seal ring may be disposed between the head main body and the retaining ring to seal a contact surface surrounding the connecting hole.

The carrier head may further include a connecting hole seal ring disposed between the cover and the head main body to seal a contact surface surrounding the connecting hole, and an upper seal ring sealing an edge of a contact surface between the head main body and the cover.

In accordance with another exemplary embodiment, a carrier head unit using sucking force to fix a substrate includes: a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes vertically passing through the housing part; a retaining ring coupled to a bottom surface of the housing part of the head main body to close lower portions of the connecting holes; a cover coupled to a top surface of the head main body to close upper portions of the connecting holes; and a control unit including a pressure sensor sensing pressure within the main passage, and an alarm notifying a variation of the pressure sensed by the pressure sensor, wherein the control unit senses a loss of pressure through the connecting hole according to a variation of a coupling state of the retaining ring.

In accordance with another exemplary embodiment, a carrier head unit using sucking force to fix a substrate includes: a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes vertically passing through the housing part to communicate with the main passage; a retaining ring coupled to a bottom surface of the housing part of the head main body to close lower portions of the connecting holes; a coupling member coupled through the connecting hole to bring the retaining ring into tight contact with the head main body, wherein an upper circumferential surface of the coupling member is provided with an inner seal ring that tightly contacts an upper portion of a surface defining the connecting hole to close an upper portion of the connecting hole; and a control unit including a pressure sensor sensing pressure within the main passage, and an alarm notifying a variation of the pressure sensed by the pressure sensor, wherein the control unit senses a loss of pressure through the connecting hole according to a variation of a coupling state of the retaining ring.

In accordance with another exemplary embodiment, a carrier head unit using sucking force to fix a substrate includes: a head main body that includes a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes opened through a bottom surface of the housing part to communicate with the main passage; a retaining ring coupled to the bottom surface of the housing part of the head main body to close lower portions of the connecting holes; a control unit including a pressure sensor sensing pressure within the main passage, and an alarm notifying a variation of the pressure sensed by the pressure sensor, wherein the control unit senses a loss of pressure through the connecting hole according to a variation of a coupling state of the retaining ring.

The head main body may be provided with a plurality of auxiliary passages that communicate with the connecting holes, respectively, and a connecting passage that connects the auxiliary passages to each other.

BRIEF DESCRIPTION OF THE DRAWINGS

Exemplary embodiments can be understood in more detail from the following description taken in conjunction with the accompanying drawings, in which.

DETAILED DESCRIPTION OF EXEMPLARY EMBODIMENTS

Figure 1:
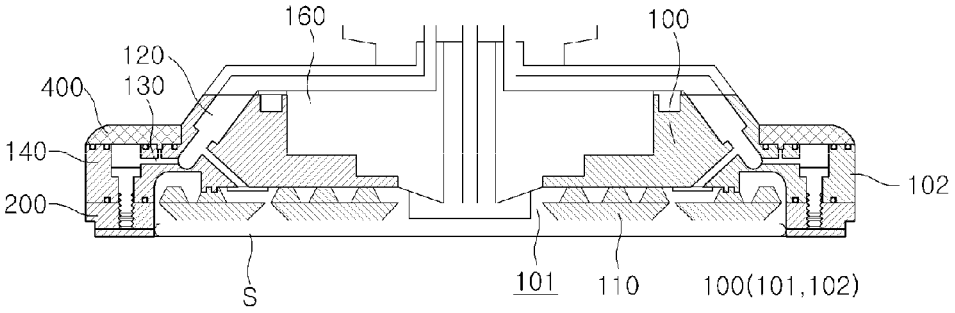
FIG. 1 is a vertical cross-sectional view illustrating a carrier head in accordance with an exemplary embodiment.

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Like reference numerals denote like elements throughout.

The following embodiments may be applied to various substrates requiring polishing. Hereinafter, a circular silicon wafer is exemplified as one of various substrates requiring polishing.

When a semiconductor device is fabricated, a chemical mechanical polishing (CMP) system may perform a global planarization process on a wafer to decrease surface roughness caused by repeated masking, etching, and interconnection processes, thereby removing height differences between a cell region and a peripheral circuit region. In addition, a chemical mechanical polishing system may precisely polish a surface of a wafer to decrease surface roughness caused by a high integrated device fabrication process and a contact/interconnection layer isolation process for forming a circuit. In these cases, a carrier head unit in accordance with an exemplary embodiment uses sucking force to fix the wafer. The carrier head unit is not limited to a component of a chemical mechanical polishing system, and thus, may be any member that uses sucking force to fix a substrate.

Figure 2:
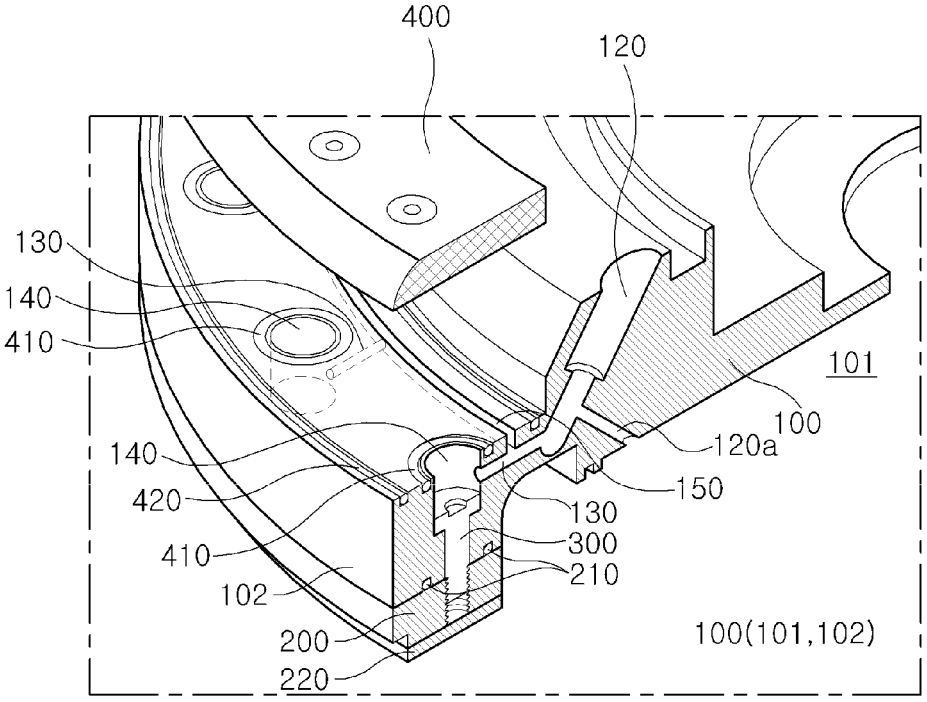
FIGS. 2, 3A and 3B are perspective views illustrating a portion of a carrier head in accordance with an exemplary embodiment.
Figure 3:
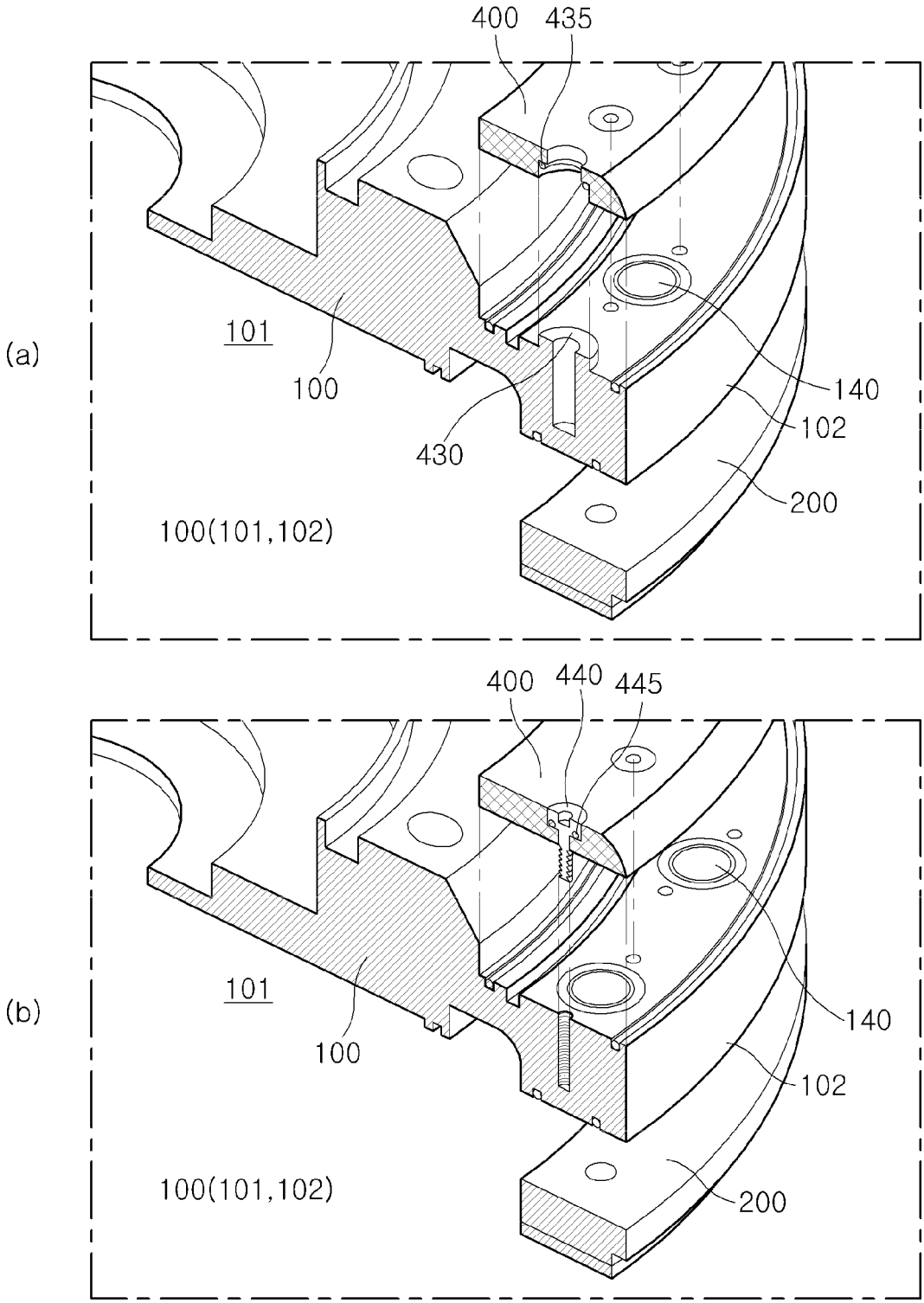
Figure 4:
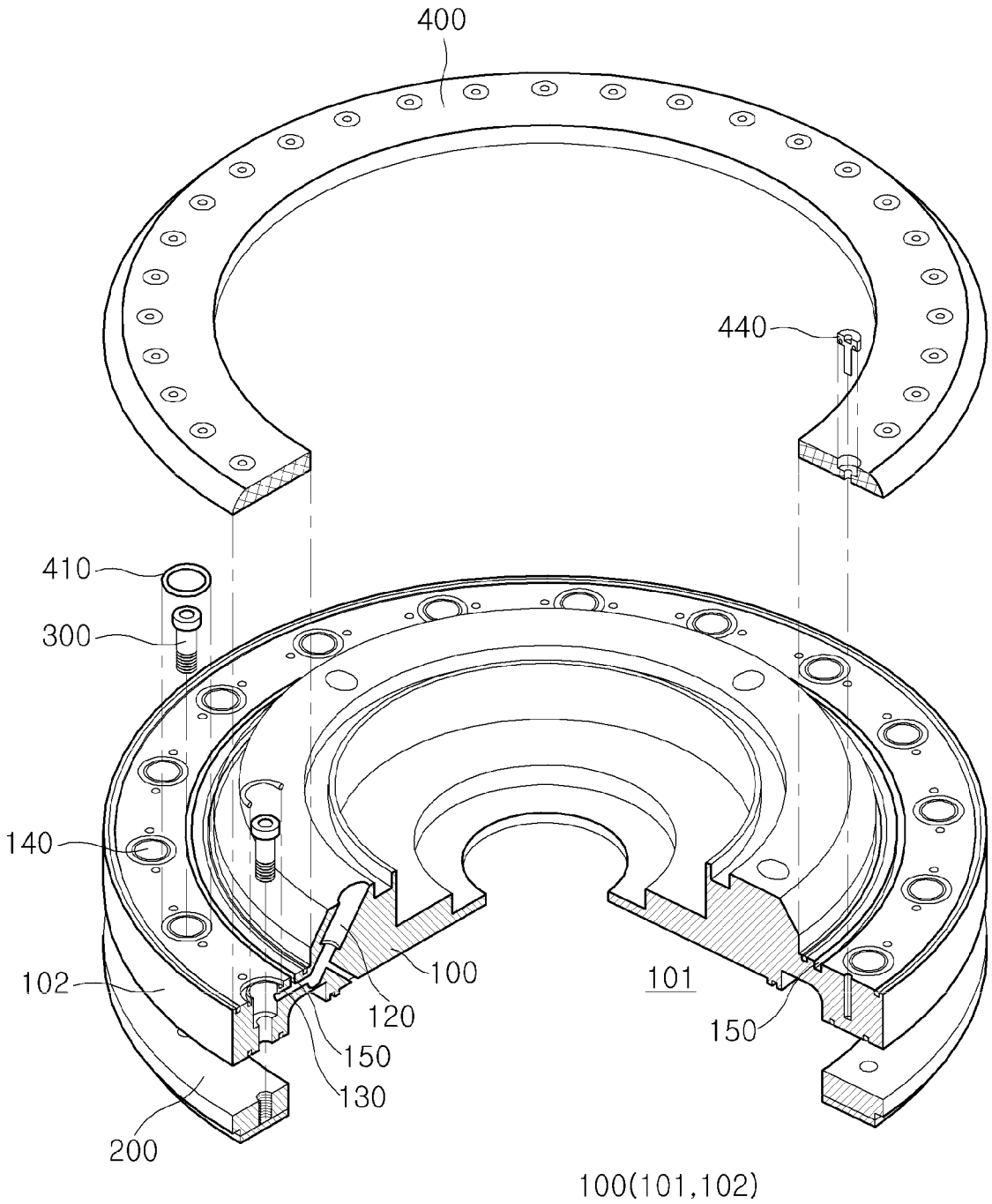
FIG. 4 is an exploded perspective view illustrating a portion of a carrier head in accordance with an exemplary embodiment.

FIG. 1 is a vertical cross-sectional view illustrating a carrier head in accordance with an exemplary embodiment. FIGS. 2, 3A and 3B are perspective views illustrating a portion of a carrier head in accordance with the current embodiment. FIG. 4 is an exploded perspective view illustrating a portion of a carrier head in accordance with the current embodiment.

Referring to FIGS. 1 to 4, a carrier head unit in accordance with the current embodiment includes a carrier head sucking and fixing a wafer S, and a control unit sensing a variation of pressure formed by the carrier head to notify the variation. The carrier head includes a head main body 100, a retaining ring 200, a plurality of coupling members 300, and a cover 400. The control unit includes a pressure sensor (not shown) and an alarm (not shown).

During a polishing process, the head main body 100 fixes the wafer S by using sucking force, and brings the wafer S into contact with a polishing pad. For example, the head main body 100 may have a circular plate shape to fix a circular wafer. The head main body 100 includes: a receiving space 101 in the central portion thereof, which is opened downward to receive the wafer S; and a housing part 102 in the edge thereof to surround the receiving space 101.

A membrane assembly 110 is disposed in the receiving space 101 to fix the wafer S. The head main body 100 is provided with main passages 120 that communicate with the receiving space 101 and the membrane assembly 110, and connecting holes 140 that vertically pass through the housing part 102. The connecting holes 140 are provided with auxiliary passages 130 that connect the main passages 120 to the connecting holes 140.

The head main body 100 is provided with connecting passages 150 that connect the auxiliary passages 130 to one another. The connecting passages 150 have upper openings that are covered by the cover 400 to be described later.

The membrane assembly 110 fixes the wafer S to the head main body 100, and is disposed in the receiving space 101 between the bottom surface of the head main body 100 and the top surface of the wafer S to suck the top surface of the wafer S, so that a polishing target surface of the wafer S is oriented downward. The bottom surface of the membrane assembly 110 is provided with through holes that communicate with the main passages 120 disposed in the head main body 100. The main passages 120 connect to the pressure sensor through a manifold assembly 160 installed at the upper side of the head main body 100. Thus, if the sucking force is generated through the main passage 120, the sucking force causes the wafer S to be into close contact with and fixed to the bottom surface of the membrane assembly 110. In the embodiment, the sucking force is generated in such a manner that air is sucked through the main passage 120. Here, since the sucking force is generated by sucking air as described above, the sucking force may be "air sucking force." Also, a vacuum state may occur depending on a pressure value, so that the sucking force may be vacuum sucking force.

The manifold assembly 160 applies different pressure to each portion of the wafer S to efficiently perform the polishing process. To this end, air is sucked with appropriate pressure through the main passage 120 from each portion of the wafer S. Since the membrane assembly 110 and the manifold assembly 160 are well known structures of a typical carrier head, a description thereof will be omitted.

The coupling members 300 for fixing the head main body 100 to the retaining ring 200 are inserted in the connecting holes 140 disposed in the housing part 102 of the head main body 100, and vertically pass through the housing part 102 of the head main body 100. The retaining ring 200 is disposed at the lower ends of the connecting holes 140 to close the lower ends of the connecting holes 140. The cover 400 is disposed at the upper ends of the connecting holes 140 to close the upper ends of the connecting holes 140.

The connecting holes 140 may be arrayed in ring shape along the housing part 102 with a certain interval (e.g., eighteen holes with an interval of 20°) to securely fix the head main body 100 to the retaining ring 200. The connecting holes 140 receive the coupling members 300, and function as spaces to pass air introduced through a space formed when the retaining ring 200 is spaced apart or removed from the head main body 100 during the polishing process.

Figure 5:
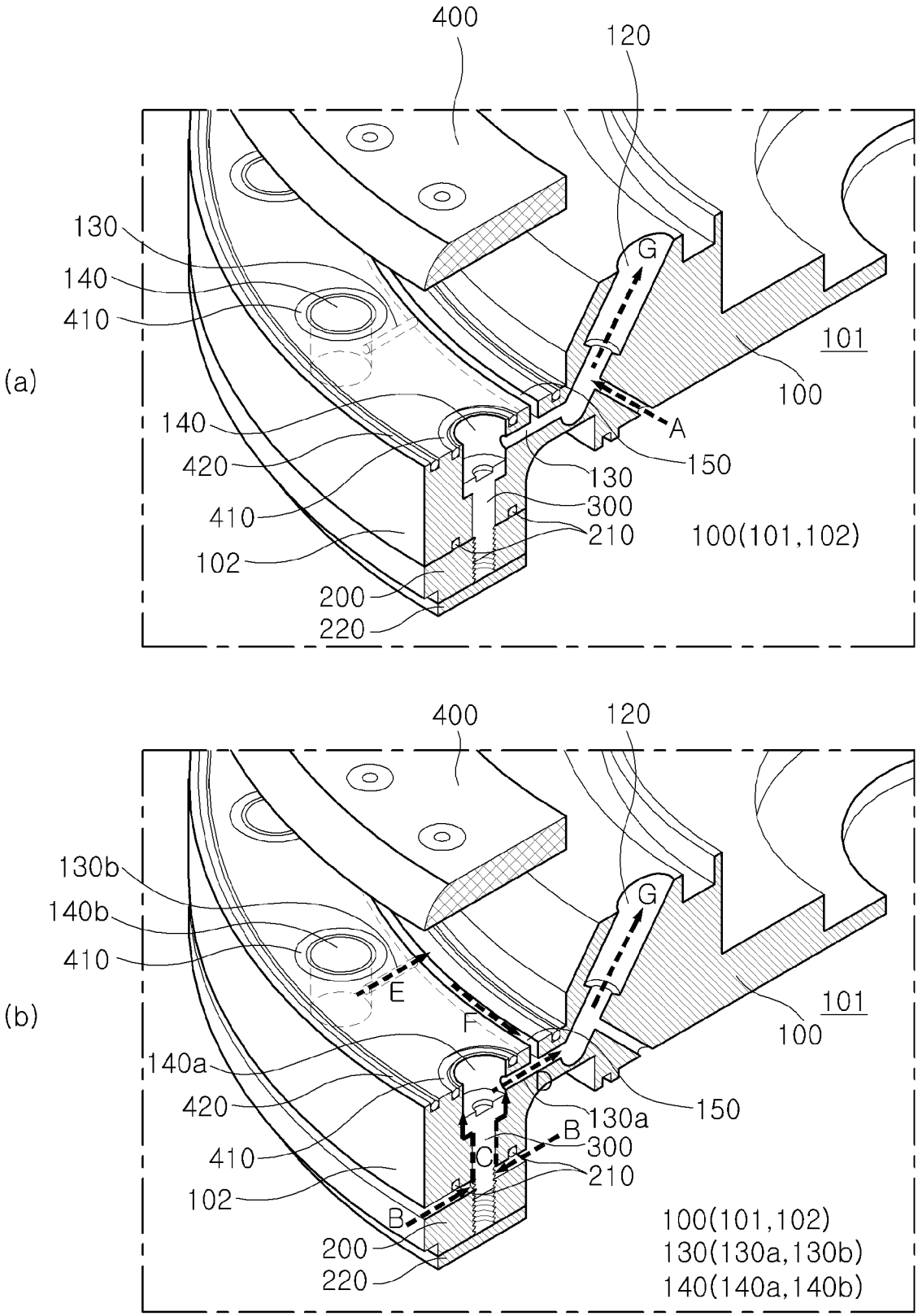
FIGS. 5A and 5B are perspective views illustrating an operation of a carrier head in accordance with an exemplary embodiment.

The auxiliary passages 130 connect the main passages 120 to the connecting holes 140. When the retaining ring 200 is spaced apart or removed from the head main body 100 during the polishing process, external air introduced between the retaining ring 200 and the head main body 100 to the connecting holes 140 is guided to the main passages 120 by the auxiliary passages 130 as illustrated in FIG. 5B. The connecting holes 140 (particularly denoted by 140*a* and 140*b*) are provided with the auxiliary passages 130 (particularly denoted by 130*a* and 130*b*), respectively. The auxiliary passages 130 connected to the connecting holes 140 are connected to one another by the connecting passages 150. Referring to FIG. 4, the connecting passages 150 may extend in ring shape along the connecting holes 140 arrayed in ring shape, to connect a plurality of the auxiliary passages 130 to one of the main passages 120.

The retaining ring 200 surrounds the side surface of the wafer S installed on the membrane assembly 110 to prevent a removal of the wafer S, and has a doughnut shape to couple to the bottom surface of the housing part 102. The wafer S is disposed on the inner side of the retaining ring 200. The inner diameter of the retaining ring 200 is greater than the diameter of the wafer S and the diameter of the membrane assembly 110 (e.g., greater than the diameter of the wafer S by approximately 0.2 to 2 mm), so that the wafer S can be easily installed on the membrane assembly 110. If the inner diameter of the retaining ring 200 is equal to the diameter of the wafer S, the wafer S may be damaged or deformed when being installed on the membrane assembly 110.

The retaining ring 200 may be formed of an abrasion-resistant plastic such as polyphenylene sulfide (PPS) or polyetheretherketone (PEEK), a ceramic such as alumina, or a metal coated with plastic or ceramic. The retaining ring 200 is coupled to the bottom surface of the housing part 102 by the coupling members 300. According, the lower ends of the connecting holes 140 formed in the bottom surface of the housing part 102 are closed.

A sealing member may be disposed on contact surfaces between the retaining ring 200 and the housing part 102 to air-tightly seal the retaining ring 200 and the housing part 102. The connecting holes 140 are arrayed along the bottom surface of the housing part 102, and a ring-shaped recess is disposed around each of the connecting holes 140. Lower seal rings 210 in the form an O-ring may be installed in the ring-shaped recess. The lower seal rings 210 may be formed of an elastic material such as rubber and have a circular cross section. The circular cross section of the lower seal rings 210 has a diameter that is slightly greater than the depth of the ring-shaped recess formed in the bottom surface of the housing part 102, so that a portion of the lower seal rings 210 can protrude out of the bottom surface of the housing part 102. Thus, when the top surfaces of the retaining rings 200 contact the bottom surface of the housing part 102, the lower seal rings 210 are deformed to thereby seal the retaining ring 200 and the housing part 102 more air-tightly.

The coupling members 300 for fixing the retaining ring 200 to the head main body 100 are inserted in the connecting holes 140, and are coupled to the retaining ring 200. Accordingly, the retaining ring 200 and the head main body 100 tightly contact each other, and are fixed. Referring to FIG. 2, the coupling member 300 may be a typical bolt having a head and a body, and is inserted through the upper portion of the connecting hole 140 to couple the retaining ring 200 to the head main body 100. A screw thread is formed around the lower end of the body of the coupling members 300, and screw holes are disposed in the retaining ring 200. The coupling members 300 are screwed to the screw holes of the retaining ring 200. However, the coupling member 300 is not limited thereto, and thus, may be any structure for coupling the retaining ring 200 to the head main body 100.

The cover 400 closes the upper ends of the connecting holes 140, and tightly contacts the top surface of the head main body 100. Referring to FIG. 4, when the connecting holes 140 are arrayed in ring shape, the cover 400 having a doughnut shape closes the upper ends of the connecting holes 140. Referring to FIG. 2, the connecting passages 150, which connect the auxiliary passages 130 connected to the connecting holes 140 to each other, extend in ring shape, and have the upper openings that are closed by the cover 400.

In the present invention, air is sucked from the main passage 120, and then, it is determined whether the retaining ring 200 is spaced apart from the head main body 100 by a change in pressure within the main passage 120. Hereupon, there is a need for coupled portions between the components to be sealed such that external air does not flow in and out at the coupled portions. Thus, connecting hole seal rings 410 and an upper seal ring 420 are disposed between the cover 400 and the head main body 100. At this time, in the embodiment, since air is sucked from the main passage 120 and a change in pressure within the main passage 120 is detected, the pressure within the main passage 120 may be referred to as air pressure. In addition, depending on the pressure within the main passage 120, the main passage 120 may be in a vacuum state and thus the pressure within the main passage 120 may be "vacuum pressure."

Referring to FIG. 2, the connecting hole seal rings 410 are disposed between the cover 400 and the head main body 100, and are provided in the form of an O-ring around the upper ends of the connecting holes 140 to seal to seal the peripheries of the connecting holes 140. Since the connecting hole seal rings 410 are the same in technical feature as the lower seal rings 210, a description thereof will be omitted.

The upper seal ring 420 for sealing the interface edge between the head main body 100 and the cover 400 is provided in plurality in the form of an O-ring at the inside and the outside of the connecting holes 140, thereby separating the interface around the connecting holes 140 from the outside of the head main body 100. Since the upper seal rings 420 are the same in technical feature as the lower seal rings 210, a description thereof will be omitted.

Referring to FIG. 3B, the cover 400 may be coupled to the head main body 100 by coupling members 440 such as bolts. Sealing members 445 air-tightly seal the interface between the coupling members 440 and the cover 400. The sealing members 445 may be provided in the form of an O-ring.

Referring to FIG. 3A, protrusions and recesses may be disposed in the contact surfaces between the cover 400 and the head main body 100, and be press-fit to each other. To this end, fixing parts 430 protrude from the top surface of the head main body 100, and recesses corresponding to the fixing parts 430 may be disposed in the cover 400. Sealing members 435 may be disposed between the fixing parts 430 and the recesses.

The control unit senses a variation of pressure within the main passages 120 to notify the variation to an operator, and includes the pressure sensor and the alarm.

The pressure sensor senses pressure within the main passages 120. When the retaining ring 200 is dislocated or removed from the head main body 100 in the polishing process, external air is introduced between the retaining ring 200 and the head main body 100 to the connecting holes 140, and flows to the main passages 120 through the auxiliary passages 130 communicating with the connecting holes 140. That is, when the retaining ring 200 is spaced apart or removed from the head main body 100 in the polishing process, external air is introduced to the main passages 120 to vary air pressure within the main passages 120, and the pressure sensor senses the variation of the air pressure.

At this point, the alarm notifies the variation sensed by the pressure sensor, to an operator. To this end, an alarming sound or a display device may be used, or the polishing process may be immediately stopped.

Hereinafter, a modification of the carrier head will now be described with reference to FIGS. 6A, 6B and 7.

Figure 6:
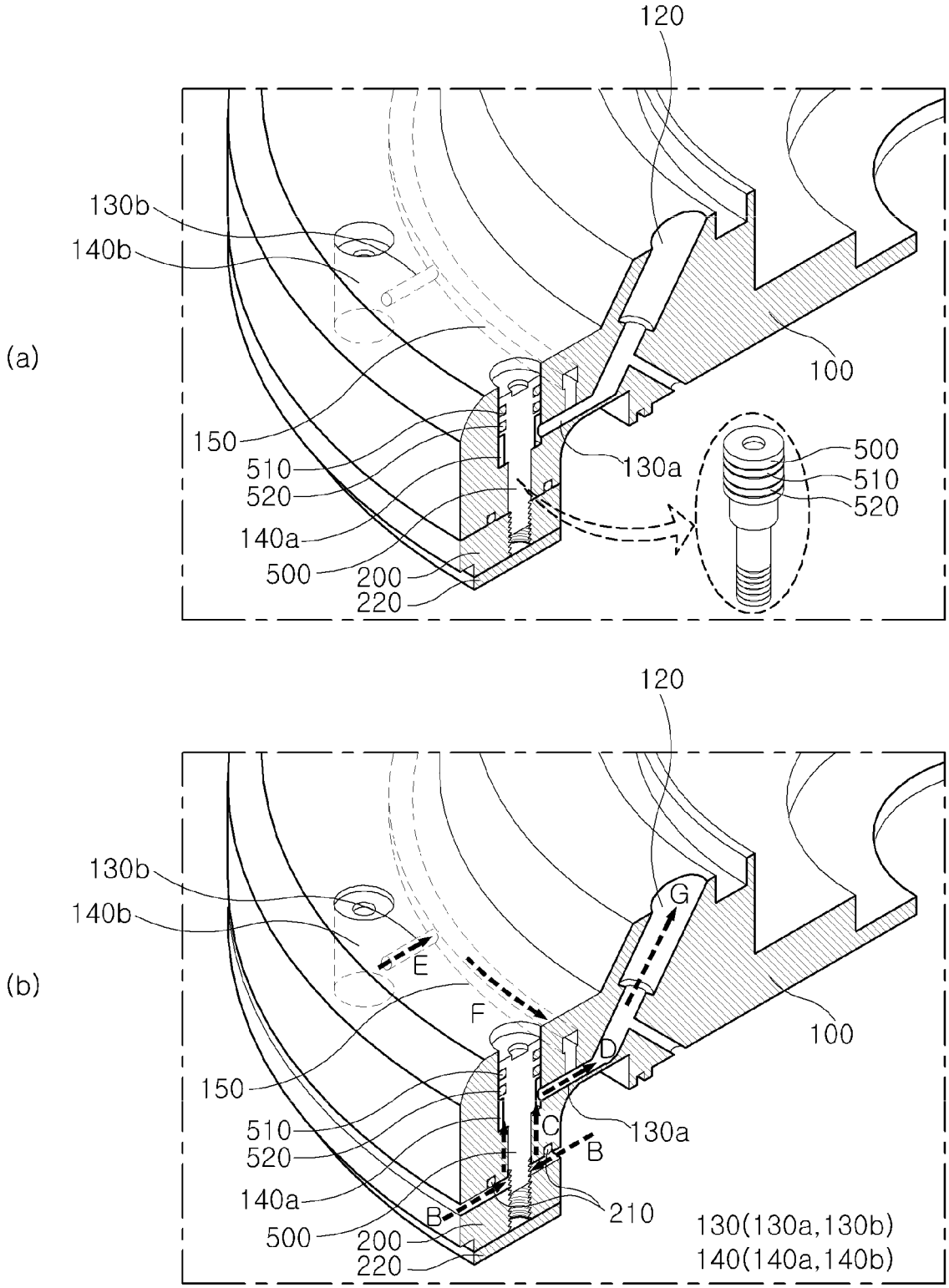
FIGS. 6A and 6B are perspective views illustrating a portion of a first modification of a carrier head in accordance with an exemplary embodiment.

FIGS. 6A and 6B are perspective views illustrating a portion of a first modification of the carrier head. FIG. 7 is a perspective view illustrating a portion of a second modification of the carrier head.

Referring to FIGS. 6A and 6B, the carrier head includes the head main body 100, the retaining ring 200, and coupling members 500. The head main body 100 includes: the receiving space 101 in the central portion thereof, which is opened downward to receive the wafer S; the housing part 102 in the edge thereof to surround the receiving space 101; the main passages 120 passing through the head main body 100 to communicate with the receiving space 101; and the connecting holes 140 vertically passing through the housing part 102 to communicate with the main passages 120. The retaining ring 200 is coupled to the bottom surface of the housing part 102 to close the lower portions of the connecting holes 140. The coupling members 500 pass through the connecting holes 140 to bring the retaining ring 200 into tight contact with the head main body 100. Since the head main body 100 and the retaining ring 200 are not modified, a description thereof will be omitted.

The coupling members 500 for fixing the retaining ring 200 to the head main body 100 and closing the upper ends of the connecting holes 140 are inserted in the connecting holes 140 to fix the retaining ring 200 to the head main body 100. The upper circumferential surface of the coupling members 500 is provided with one or more inner seal rings 510 and 520 that tightly contact the upper portion of surfaces defining the connecting holes 140 to close the upper portions of the connecting holes 140.

Figure 7:
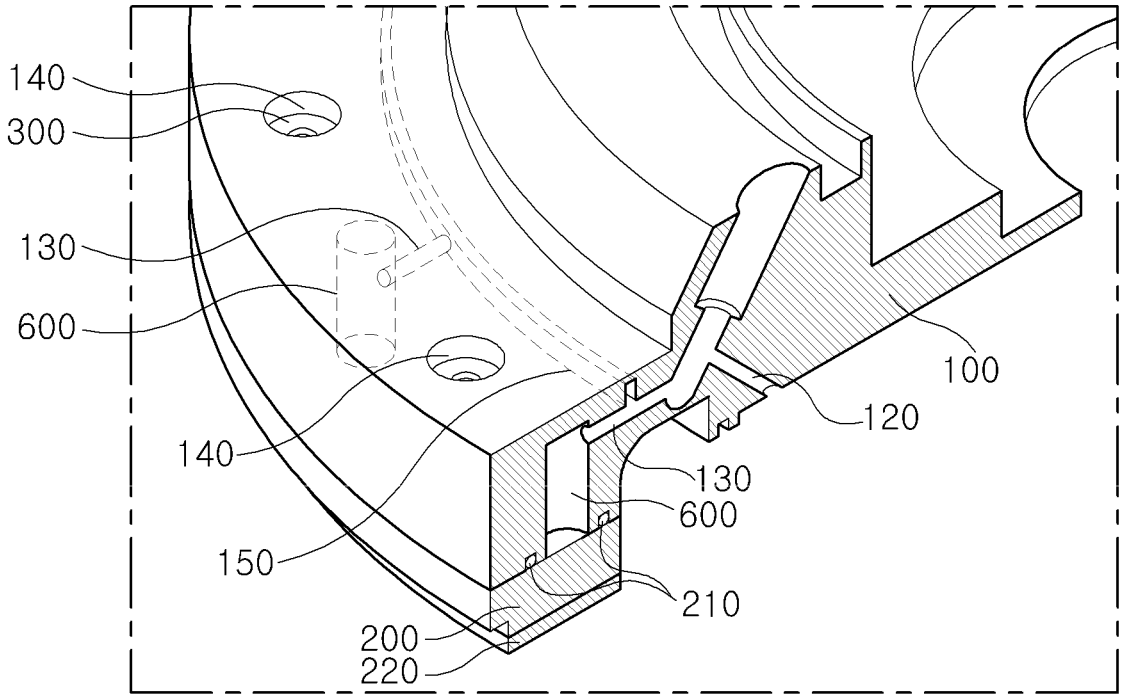
FIG. 7 is a perspective view illustrating a portion of a second modification of a carrier head in accordance with an exemplary embodiment.

Referring to FIG. 7, the carrier head includes the head main body 100 and the retaining ring 200. The head main body 100 includes: the receiving space 101 in the central portion thereof, which is opened downward to receive the wafer S; the housing part 102 in the edge thereof to surround the receiving space 101; the main passages 120 passing through the head main body 100 to communicate with the receiving space 101; and a plurality of connecting holes 600 opened through the bottom surface of the housing part 102 to communicate with the main passages 120. The retaining ring 200 is coupled to the bottom surface of the housing part 102 to close the lower portions of the connecting holes 600. A description of the unmodified parts except for the second modification will be omitted.

When the head main body 100 is coupled to the retaining ring 200 by the coupling members 300 passing through coupling holes different from the connecting holes 600, or by a separate structure, the connecting holes 600 are opened only through the bottom surface of the housing part 102, and communicate with the main passages 120. That is, the connecting holes 600, which are different from the coupling holes coupled to the coupling members 300, function as spaces to pass air introduced through a space formed when the retaining ring 200 is spaced apart or removed from the head main body 100 during a polishing process. The retaining ring 200 is coupled to the bottom surface of the housing part 102 to close the lower ends of the connecting holes 600.

Hereinafter, an operation of a carrier head according to an exemplary embodiment will now be described with reference to the accompanying drawings.

FIGS. 5A and 5B are perspective views illustrating an operation of a carrier head in accordance with an exemplary embodiment.

The wafer S is installed on a carrier head to perform a chemical mechanical polishing process. When air is sucked through the main passages 120, sucking force of the air brings the wafer S into tight contact with the bottom surface of the membrane assembly 110. At this point, the air is introduced to the manifold assembly 160 along the main passage 120 (from a path A to a path G) as illustrated in FIG. 5A, and air pressure within the main passage 120 is constant, and is sensed in real time by the pressure sensor to sense a variation of the pressure air within the main passage 120 during the chemical mechanical polishing process.

When the chemical mechanical polishing process is started, the carrier head brings the wafer S into tight contact with the polishing pad, and rotates. During the chemical mechanical polishing process, a vibration due to the rotation of the carrier head may loose the coupling members 300 coupling the head main body 100 to the retaining ring 200. In this case, the retaining ring 200 may be spaced apart the head main body 100 as illustrated in FIG. 5B. Then, the sealing of the lower seal rings 210 between the retaining ring 200 and the head main body 100 may be jeopardized. In this case, external air may be introduced between the retaining ring 200 and the head main body 100 (along paths B), and flow between the connecting hole 140*a* and the coupling member 300 (along a path C) to the main passage 120 (along the path G) through the auxiliary passage 130*a* (along a path D).

When the external air is introduced to the main passage 120 to slightly vary the air pressure within the main passage 120, the pressure sensor senses the variation, and the alarm notifies the variation to an operator. That is, even when the retaining ring 200 is slightly spaced apart from the head main body 100, external air may be introduced to the main passage 120 to vary the inner pressure thereof, so that the spacing or removal of the retaining ring 200 can be sensed. The alarm notifies the variation to the operator by using an alarming sound or a display device, or immediately stops the polishing process.

Since the connecting holes 140 may be arrayed with a certain interval along the circumference of the head main body 100, even when only one portion of the head main body 100 is spaced apart from the retaining ring 200, the spaced portion can be sensed according to a variation of air pressure within the main passages 120. For example, when the head main body 100 is spaced apart from the retaining ring 200 in a region including the connecting hole 140*b* communicating with the main passage 120 through the connecting passage 150, not in a region including the connecting hole 140*a* directly communicating with the main passage 120, external air is introduced between the retaining ring 200 and the bottom surface of the head main body 100, and flows between the connecting hole 140*b* and the coupling member 300 to the connecting passage 150 through the auxiliary passage 130*b* (along a path E), and the air arriving at the connecting passage 150 flows along the connecting passage 150 (along a path F) to the main passage 120 through the auxiliary passage 130*a*. The air arriving at the main passage 120 varies air pressure within the main passage 120, and the pressure sensor senses the variation, and notifies the variation to the alarm.

In the first modification, when a vibration due to rotation of the carrier head looses the coupling members 300 coupling the head main body 100 to the retaining ring 200, the retaining ring 200 may be spaced apart the head main body 100 as illustrated in FIG. 5B. Then, the sealing of the lower seal rings 210 between the retaining ring 200 and the head main body 100 may be jeopardized. In this case, external air may be introduced between the retaining ring 200 and the head main body 100 (along the paths B), and flow between the connecting hole 140*a* and the coupling member 300 (along the path C) to the main passage 120 (along the path G) through the auxiliary passage 130*a* (along the path D).

Also in the first modification, since the connecting holes 140 may be arrayed with a certain interval along the circumference of the head main body 100, even when only one portion of the head main body 100 is spaced apart from the retaining ring 200, the spaced portion can be sensed according to a variation of air pressure within the main passages 120, which is described above in detail.

In the second modification, when the retaining ring 200 is spaced apart from the bottom surface of the head main body 100, the sealing of the lower seal rings 210 between the retaining ring 200 and the head main body 100 may be jeopardized. At this point, external air may be introduced between the retaining ring 200 and the bottom surface of the head main body 100, and sequentially flow through the connecting passage 150 and the auxiliary passage 130*a* to the main passage 120.

In accordance with the embodiments, it is sensed in real time whether a retaining ring surrounding and protecting the side portion of a wafer is spaced away or removed from a head main body by a vibration during a chemical mechanical polishing process, thereby preventing a polishing defect or damage of the wafer.

In addition, even when the retaining ring is slightly spaced apart from the head main body, a loss of air pressure between the retaining ring and the head main body is sensed and is quickly handled, thereby preventing breakage and breakdown of processing units and reducing the possibility of an accident.

Accordingly, productivity of the chemical mechanical polishing process can be improved, and maintenance costs can be reduced.

Although it has been described in the aforementioned embodiments and modifications that a change in air pressure of the main passage 120 is detected, it means a change in pressure within the main passage 120. Thus, the change in pressure within the main passage 120 may be explained by a change in vacuum pressure.

Although the carrier head and the carrier head unit have been described with reference to the specific exemplary embodiments, they are not limited thereto. Therefore, it will be readily understood by those skilled in the art that various modifications and changes can be made thereto without departing from the spirit and scope of the present invention defined by the appended claims.

What is claimed is:

1. A carrier head unit using sucking force to fix a substrate, the carrier head unit comprising:

a head main body that comprises a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes passing through the housing part vertically;

a retaining ring coupled to a bottom surface of the housing part of the head main body to close lower portions of the connecting holes;

a cover coupled to a top surface of the head main body to close upper portions of the connecting holes; and wherein the head main body is provided with a plurality of auxiliary passages that are connected to the connecting holes, respectively, and a connecting passage that connects the auxiliary passages to each other, wherein the connecting passage has an opened top surface and connects each of the plurality of auxiliary passages to the main passage, a control unit comprising a pressure sensor sensing pressure within the main passage, and an alarm notifying a variation of the pressure sensed by the pressure sensor, wherein the control unit is configured to sense a coupling state between the head main body and the retaining ring in real time by sensing a variation in air pressure of the main passage measured by the pressure sensor as external air that is introduced into a space between the head main body and the retaining ring depending on a variation of the coupling state between the head main body and the retaining ring is introduced into the main passage through the plurality of connecting holes and the connecting passage.

2. The carrier head of claim 1, wherein a lower seal ring is disposed between the head main body and the retaining ring to seal a contact surface surrounding the connecting hole.

3. The carrier head of claim 1, comprising a connecting hole seal ring disposed between the cover and the head main body to seal a contact surface surrounding the connecting hole, and an upper seal ring sealing an edge of a contact surface between the head main body and the cover.

4. A carrier head unit using sucking force to fix a substrate, the carrier head unit comprising:

a head main body that comprises a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes passing through the housing part vertically;

a retaining ring coupled to a bottom surface of the housing part of the head main body to close lower portions of the connecting holes;

wherein the plurality of connecting holes are structured to pass external air introduced through a space formed between the head main body and the retaining ring, wherein the head main body is provided with a plurality of auxiliary passages that are connected to the connecting holes, respectively, and a connecting passage that connects the auxiliary passages to each other, wherein the connecting passage has an opened top surface and connects each of the plurality of auxiliary passages to the main passage, a coupling member coupled through the connecting hole to bring the retaining ring into tight contact with the head main body, wherein an upper circumferential surface of the coupling member is provided with an inner seal ring that tightly contacts an upper portion of a surface defining the connecting hole to close an upper portion of the connecting hole; and a control unit comprising a pressure sensor sensing pressure within the main passage, and an alarm notifying a variation of the pressure sensed by the pressure sensor, wherein the control unit is configured to sense a coupling state between the head main body and the retaining ring in real time by sensing a variation in air pressure of the main passage measured by the pressure sensor as external air that is introduced into a space between the head main body and the retaining ring depending on a variation of the coupling state between the head main body and the retaining ring is introduced into the main passage through the plurality of connecting holes and the connecting passage.

5. The carrier head of claim 4, wherein a lower seal ring is disposed between the head main body and the retaining ring to seal a contact surface surrounding the connecting hole.

6. A carrier head unit using sucking force to fix a substrate, the carrier head unit comprising:

a head main body that comprises a receiving space in a central portion thereof, the receiving space being opened downward to receive the substrate, a housing part in an edge thereof to surround a side portion of the receiving space, a main passage passing through the head main body to communicate with the receiving space, and a plurality of connecting holes passing through the housing part vertically;

a retaining ring coupled to the bottom surface of the housing part of the head main body to close lower portions of the connecting holes;

wherein the head main body is opened at a bottom surface of the housing part, wherein the plurality of connecting holes are structured to pass external air introduced through a space formed between the head main body and the retaining ring, wherein the head main body is provided with a plurality of auxiliary passages that are connected to the connecting holes, respectively, and a connecting passage that connects the auxiliary passages to each other, wherein the connecting passage connects each of the plurality of auxiliary passages to the main passage, a control unit comprising a pressure sensor sensing pressure within the main passage, and an alarm notifying a variation of the pressure sensed by the pressure sensor, wherein the control unit is configured to sense a coupling state between the head main body and the retaining ring in real time by sensing a variation in air pressure of the main passage measured by the pressure sensor as external air that is introduced into a space between the head main body and the retaining ring depending on a variation of the coupling state between the head main body and the retaining ring is introduced into the main passage through the plurality of connecting holes and the connecting passage.

7. The carrier head of claim 6, wherein a lower seal ring is disposed between the head main body and the retaining ring to seal a contact surface surrounding the connecting hole.

* * * * *